US008671497B2

(12) United States Patent
Kirsh

(10) Patent No.: US 8,671,497 B2
(45) Date of Patent: Mar. 18, 2014

(54) TOOTHBRUSH

(76) Inventor: Mordechai Kirsh, Jerusalem (IL)

( * ) Notice: Subject to any disclaimer, the term of this patent is extended or adjusted under 35 U.S.C. 154(b) by 251 days.

(21) Appl. No.: 13/135,641

(22) Filed: Jul. 13, 2011

(65) Prior Publication Data

US 2011/0271471 A1 Nov. 10, 2011

Related U.S. Application Data

(63) Continuation-in-part of application No. PCT/IL2010/000041, filed on Jan. 17, 2010.

(30) Foreign Application Priority Data

Jan. 22, 2009 (IL) ..... 196650

(51) Int. Cl.
*B25G 1/00* (2006.01)

(52) U.S. Cl.
USPC ..... 15/144.2; 15/167.1; 15/172

(58) Field of Classification Search
USPC ..... 15/144.2, 167.1, 172
See application file for complete search history.

(56) References Cited

U.S. PATENT DOCUMENTS

| | | | | |
|---|---|---|---|---|
| 47,927 | A * | 5/1865 | Burtnett | 403/68 |
| 759,490 | A | 5/1904 | Yates | |
| 1,172,109 | A * | 2/1916 | Cammack | 15/172 |
| 1,507,500 | A | 9/1924 | Metz | |
| 1,835,319 | A | 12/1931 | Myers | |
| 2,084,873 | A | 6/1937 | Strause | |
| 2,254,365 | A | 9/1941 | Griffith | |
| 2,310,571 | A | 2/1943 | Brady | |
| 2,675,573 | A | 4/1954 | Goldberg | |
| 4,053,959 | A | 10/1977 | Wiley | |
| 4,137,593 | A | 2/1979 | Porper | |
| 4,403,623 | A | 9/1983 | Mark | |

(Continued)

FOREIGN PATENT DOCUMENTS

| | | |
|---|---|---|
| CH | 247968 | 4/1947 |
| CH | 2479968 | 4/1947 |

(Continued)

OTHER PUBLICATIONS

International Search Report for PCT/IL2010/000041 mailed Jun. 1, 2010.

(Continued)

*Primary Examiner* — Lee D Wilson
*Assistant Examiner* — Shantese McDonald
(74) *Attorney, Agent, or Firm* — Fleit Gibbons Gutman Bongini & Bianco PL; Paul D. Bianco; Gary S. Winer

(57) ABSTRACT

A toothbrush designed to enable horizontal brushing of the contact line between the teeth and the gums, which is composed of a handle and a brush. One end of the handle has a protruding arm, which constitutes an extension of the handle's longitudinal axis and ends in a ball. The brush is convex-concave/bean shaped with protruding bristles on one side and a hollow socket attached to the other side; the socket has an opening that faces the handle. To attach the brush to the handle, the ball is inserted into the cavity in the socket, so that a ball and socket joint is formed that enables the user to spatially change the angle between the brush and the handle.

13 Claims, 24 Drawing Sheets

(56) References Cited

U.S. PATENT DOCUMENTS

| | | | | |
|---|---|---|---|---|
| 4,727,618 | A | 3/1988 | Mahoney | |
| 4,829,621 | A * | 5/1989 | Phenegar | 15/172 |
| 5,001,803 | A | 3/1991 | Discko | |
| 5,175,901 | A | 1/1993 | Rabinowitz | |
| 5,479,951 | A | 1/1996 | Denebeim | |
| 5,491,866 | A * | 2/1996 | Simonds | 15/167.1 |
| 5,551,115 | A * | 9/1996 | Newville | 15/172 |
| 5,692,260 | A | 12/1997 | Haiduk | |
| 5,694,658 | A | 12/1997 | Huang et al. | |
| 6,182,321 | B1 | 2/2001 | Wu | |
| 2003/0200618 | A1 | 10/2003 | Lin | |
| 2003/0208870 | A1 | 11/2003 | Jimenez | |
| 2007/0277339 | A1 | 12/2007 | Barsheshet | |
| 2007/0283519 | A1 | 12/2007 | Moss | |
| 2008/0216262 | A1 | 9/2008 | Kennedy | |
| 2011/0138563 | A1 * | 6/2011 | Phgura | 15/167.1 |

FOREIGN PATENT DOCUMENTS

| | | |
|---|---|---|
| DE | 1868324 | 3/1963 |
| DE | 1929523 | 12/1965 |
| DE | 1532810 | 3/1970 |
| DE | 814122 | 9/1978 |
| DE | 7814122 | 9/1978 |
| DE | 202004002205 U | 3/2005 |
| DE | 102004049606 | 4/2006 |
| IL | 196650 | 1/2009 |
| IL | 1996650 | 1/2009 |
| JP | 2243105 | 9/1990 |
| JP | 11137340 | 5/1999 |
| JP | 11253231 | 9/1999 |
| JP | 2004089346 | 3/2004 |
| WO | 9628993 | 9/1996 |
| WO | 2004019808 | 3/2004 |
| WO | 2006073218 | 7/2006 |
| WO | 2008015616 | 2/2008 |
| WO | 2009031396 | 8/2008 |
| WO | 2008115926 | 9/2008 |
| WO | 2010084486 | 7/2010 |

OTHER PUBLICATIONS

International Preliminary Report and Written Opinion for PCT/IL2010/000041 mailed Jun. 1, 2010.

* cited by examiner

TOOTHBRUSH

TECHNICAL FIELD

The present invention refers to a toothbrush whereby the user can change the angle between the toothbrush head and the handle.

BACKGROUND ART

When using a toothbrush to brush one's teeth, it is important to clean the contact line between the teeth and the gums. Effective brushing is obtained when the brush is moved (back and forth) horizontally (at a certain angle). Horizontal brushing along the said contact line is easy and simple when it is performed on the outer side of the teeth (the side facing the cheek). It is, however, more difficult and cumbersome to brush the inner side of the teeth (the side facing the tongue), and especially along the inner curvature of the front teeth. In addition, effective brushing of the back (posterior) molars is also a known problem. The toothbrush, subject of the invention, offers a good and effective solution to the above problems.

THE INVENTION

The primary objective of the present invention is to serve as a toothbrush (1) that enables the user to brush his or her teeth in a good and effective manner and particularly to enable both horizontal brushing along the contact line between the teeth and the gums (on both the outer and inner sides of the teeth) and effective brushing of the back molars.

The present invention refers to a toothbrush (1) that comprises a handle (2) with an arm (3) that protrudes from one end, which constitutes an extension of the handle's longitudinal axis and ends in a ball (4). The toothbrush (1) also includes a brush (5) with protruding bristles (6) on one side and a hollow socket accessory (7) attached to the other side. One side of the socket accessory (7) (hereinafter referred to as the "socket") is attached, as mentioned, to the brush (5) and the other side of the socket has a hole (8). In order to attach the handle (2) to the brush (5), the ball (4) is inserted into the hole in the socket (7) so that the arm (3) protrudes from the hole (8). When the ball (4) is inserted into the cavity in the socket (7), a ball and socket joint is created that enables the user to change the angle (360 degrees) between the brush (5) and the handle (2).

The handle (2) can assume any of the standard toothbrush designs and sizes or any other design that offers the user a good grip on the handle. The handle (2) can be made of a variety of materials, such as those commonly used to manufacture standard toothbrush handles. The arm (3) that protrudes from the end of the handle (2) can be made of the same material used to manufacture the handle or metal or any other rigid material. The arm may be thin and only a few millimeters long (although the invention and the application cover and refer to other dimensions as well). The ball (4) at the end of the arm (3) can be made of a variety of materials such as plastic, metal, and so on. The handle (2), arm (3) and ball (4) may be one solid, integral part or they may be separate parts that are joined together in either a permanent or detachable manner.

The brush (5) has a convex/concave shape, or in other words it is slightly curved (or bean shaped), on both its longitudinal sides, as depicted for instance in Drawing No. 2. More specifically, the surface of the brush (5), from which the bristles (6) protrude, is bean shaped. This design of the brush (5) corresponds to the curved shape of the gums arch so as to achieve efficient and effecting brushing, particularly along the contact line between the teeth and the gums.

The curved parts of the brush (5) are designed to match the curvature of the gums. Aside from the brush's curved (convex/concave) design, it can, in general, assume different designs and sizes of standard toothbrushes and is made of materials customarily used in the manufacture of toothbrushes. The bristles (6) that protrude from the surface of the brush (5) are also arranged in a convex/concave form, following the curved outline of the brush (5), as depicted for instance in Drawing No. 2.

The socket accessory (7) is attached to the back of the brush (5), i.e. bristles (6) protrude from one side of the brush (5), and the socket accessory (7) is attached to the other side. The socket (7) can assume a variety of shapes such as a cylinder, a dome, a square prism and so on. The socket accessory (7) can be made of a variety of materials such as plastic, metal and so on. The drawings attached to the application depict a socket accessory (7) (shaped as a cone) whose base (wide side) is attached to the brush (5) and whose narrow end has an opening (8). The diameter of the opening (8) is such that the arm (3) can fit into it and move within it.

At the same time, however, the diameter of the opening (8) is smaller than the diameter of the ball (4) so as to prevent the extraction of the ball (4) from the hole of the socket (7) and, as a result, the separation of the handle (2) from the brush (5). The hollow socket (7) can be an integral part of the brush (5) or it can be a part that is joined to it in either a permanent or detachable manner.

The fact that the toothbrush (1) has a ball and socket joint connection [the combination of the arm (3) and the ball (4) that are inserted into the cavity in the socket (7)] enables the user to change the angle between the brush (5) and the handle (2), which can range between 0 and 360 degrees. [Clarification: The change in the angle between the handle (2) and the brush (5) is a spatial change (i.e. three dimensional)]. The ability to change the angle, as mentioned, enables the user to adjust the brush (5) to a variety of positions, up to a horizontal position, while brushing along the contact line between the teeth and the gums. The fact that the brush (5) is curved or bean shaped and that the bristles (6) themselves are arranged on a curvature on the brush (5) leads to a more close effective cleaning action.

The hollow socket (7) can have one or more cut-outs (71) that enable the formation of a 90 degree angle between the handle (2) and the brush (5); in other words, a 90 degree angle between the longitudinal axis of the handle (2) and the longitudinal axis of the bristles (6). It is recommended that the hollow socket (7) will include four cut-outs (71), as depicted for instance in Drawing No. 6.

Attaching the handle (2) to the body of the brush (5): In order to render the ball and socket joint stable and rigid, a spring (9) can and should be located in the base of the cavity in the socket (7), so as to exert pressure between the base of the socket (7) and the ball (4), as depicted for instance in Drawing No. 3.

The force and pressure that the spring (9) exerts on the ball (4) impart a certain rigidity to the angle between the brush (5) and the handle (2) so that after the user exerts pressure on the handle in order to obtain the desired angle, the regular brushing action will not change the said angle. The spring (9) should exert enough pressure so as to prevent any unintentional change in angle (during regular brushing) and still be flexible enough so as to enable the user to intentionally change the angle.

Alternately, the ball (4) itself may be made of an elastic and flexible material that will exert pressure on the inner walls of the cavity in the socket (7), so as to achieve the same effect as the said spring.

The first embodiment of the present invention refers to a toothbrush (1) whose components [handle (2), arm (3), ball (4), hollow socket (7), and brush (5)] (excluding the bristles and spring) are made of a single piece and are joined to one another in an integral manner [excluding the connection between the ball (4) and the hollow socket (7), so as to preserve the ball and socket joint's ability to move]. In this case, when the bristles (6) of the brush (5) wear out, the toothbrush (1) can be replaced with a new toothbrush (1), similar to the way in which standard toothbrushes are commonly replaced.

The second embodiment of the present invention refers to a toothbrush (1) whose handle (2) [including the arm (3) and ball (4)] is designed for extended use and only the brush (5) [including the bristles (6) and hollow socket (7) that are attached to it in a permanent or integral manner] is replaced when the bristles (6) wear out. In this case, the user attaches the brush (5) to the handle (2) by forcefully inserting the ball (4) into the cavity in the socket (7), and vice versa. Again, the brush (5) can be replaced whenever the bristles wear out.

The third embodiment of the present invention refers to a toothbrush (1) whose handle (2) [including the arm (3) and ball (4)] and the hollow socket (7) are designed for extended use and only the brush (5) [including the bristles (6) but not the hollow socket (7)] is replaced whenever the bristles (6) wear out. In this case, the user attaches the brush (5) to the hollow socket (7). A variety of joining options exist, such as screwing or sliding tracks. Drawing No. 4 depicts the possibility of attaching the brush to the hollow socket by means of screwing. In this case, the base of the socket (7) is round and has an exterior thread (72) and the brush (5) has a cavity whose inner, circumferential side has a matching interior thread (51).

Alternately, the brush (5) may include a protrusion with an exterior thread that can be screwed into a matching recess in the base of the socket (7). Drawing No. 5 depicts the possibility of attaching the brush to the socket by means of sliding tracks (52) on the back of the brush, and a matching plate (73) on the base of the socket (7) which is designed to slide into the sliding tracks.

The fourth embodiment of the invention refers to a toothbrush (10) that comprises a handle (11) and a brush (12), as depicted in Drawings Nos. 12-23.

The handle (11) is composed of three parts: the main body (111) of the handle, a short shaft with a square cross-section (112) and a ball (113), as depicted for instance in Drawings Nos. 12 and 13. The main body (111) can be shaped like a standard toothbrush handle. The square shaft (112) has the general shape of a square or quadrangle. The square shaft connects and joins the ball (113) to the main body (111) of the handle (11). These three components (111) (112) (113) can be made of a single solid piece. The square shaft (112) can be very short, and its length can be on the order of approximately 3 mm, although the invention and present patent application cover and refer to other dimensions as well.

The diameter of the ball (113) can be very small, and it can be on the order of approximately 6 mm, although the invention and present patent application cover and refer to other dimensions as well.

The square shaft (112) is, as mentioned, shaped like a quadrangular profile with four sides (1121) whose centers can and should be slightly recessed so that the corners (1122) of the square shaft (112) protrude slightly. The function of the protrusions (1122) is to enable the handle (11) to lock into place during use, as explained below. Drawing No. 13 depicts the recessed sides (1121) and protruding corners (1122).

The general shape of the brush (12) is as described in the previous embodiments of the invention (i.e. bean shaped), whereby the bristles (121) are attached on one side of the brush (12) and the socket (13) is attached to the other side. The cavity in the socket (13) is spherical and corresponds in general to the shape and dimensions of the ball (113) located at the end of the handle (11) of the toothbrush (10). Drawings Nos. 14-16 depict the brush (12).

The socket (13) has four cut-outs (131). Each of the cut-outs (131) is at a 90 degree angle (approximately) to the adjacent two cut-outs on either side, as depicted in the drawings. Between the four two cut-outs are four prongs (132) positioned so that each cut-out (131) is flanked on either side by a prong (132), as depicted in the drawings attached to the application. The function of the cut-outs (131) and the prongs (132) is to enable the square shaft (112) to lock into the brush (10) when in use, as explained below.

In order to attach the handle (11) to the brush (12), the user inserts the ball (113) into the spherical cavity in the socket (13), as depicted for instance in Drawing No. 17. The ball (113) locks into the cavity in the socket (13) and cannot be removed easily unless substantial force is applied. In other words, the handle (11) can be disengaged from the brush (12) only in an intentional manner. Nevertheless, the handle (11) can rotate freely relative to the brush (12). The handle (11) can be locked into the brush (12) at a (approximate) angle of 90 degrees by inserting the square shaft (112) into one of the cut-outs (131), so that the protrusions (1122) actually wrap around the side of the (the top corner of the) prong (132), stabilizing and locking the handle (11) into place relative to the brush (12).

By applying a reasonable amount of force, the handle (11) can be unlocked from its position on the brush (12) and set at any angle the user desires. When the toothbrush (10) is used at an angle other than 90 degrees, the handle (11) is locked onto the brush (12) by the friction between the ball (113) and the sides of the cavity in the socket (13).

The fifth embodiment of the invention refers to a toothbrush (100) that comprises a handle (110) and brush (120), as depicted in Drawings Nos. 24-29.

The handle (11) is shaped like a standard toothbrush handle, but has a relatively thin, flexible neck. The neck (111) of the handle (110) is made of a material with plastic properties and its thinness imparts the following properties: By applying reasonable force, the neck (111) can be bent and the angle between the handle (110) and the brush (120) can be adjusted according to the user's desire.

Nevertheless, the force applied during the brushing operation to the brush (100) in its entirety does not cause the neck (111) to bend and therefore does not change the said angle.

A metal wire (112) can and should run along the inner part of the neck (111) so as to maintain the correct balance between the ability to bend the neck (111) and the resistance of the neck to undesired bending due to the application of relatively low pressure, such as the pressure applied when brushing the teeth.

The general shape of the brush (120) is identical to that in the previous embodiments of the invention described above (i.e. bean shaped), whereby the bristles are attached on one side of the brush (120) and the handle (110) is attached to the other side. The handle (110) is attached at the center of the back of the brush (120) in a way that enables the user to use the brush (100) at a variety of angles, as opposed to attaching the handle to the bottom end of the brush, which does not enable a wide variety of brushing angles.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

In the first, second and third embodiments of the invention, the toothbrush (1) comprises a brush (5) with the hollow socket (7), and the handle (2) with a ball (4), which is inserted into the cavity of the socket (7), thus attaching the brush to the handle.

In order to prevent the accumulation of toothpaste or debris in the cavity of the socket (7), which might interfere with the movement of the ball (4) within it, the inventor hereby adds a drainage hole (555) that runs from the floor of the socket cavity (7) through the body of the brush (5) so that water, residual toothpaste, and debris can drain from the floor of the socket cavity (7) to the bristles area (6).

In the fourth embodiment of the invention, the toothbrush (10) comprises a brush (12) with a hollow socket (13), and a handle (11) with a ball (113), which is inserted into the hole of the socket (13), thus attaching the brush (12) to the handle (11).

In order to prevent the accumulation of toothpaste or debris in the cavity of the socket (13), which might interfere with the movement of the ball (113) within it, the inventor hereby adds a drainage hole (555) that runs from the floor of the socket cavity (13) through the body of the brush (12) so that water, residual toothpaste, and debris can drain from the floor of the socket cavity (13) to the bristles area (121).

DESCRIPTION OF THE DRAWINGS

Drawings No. 1A and 1D depict the toothbrush (1) with a 180 degree angle between the longitudinal axis of the bristles of the brush (5) and the longitudinal axis of the handle (2).

Drawings No. 1B and 1E depict the toothbrush (1) with a 45 degree angle between the longitudinal axis of the bristles of the brush (5) and the longitudinal axis of the handle (2).

Figure 1A:
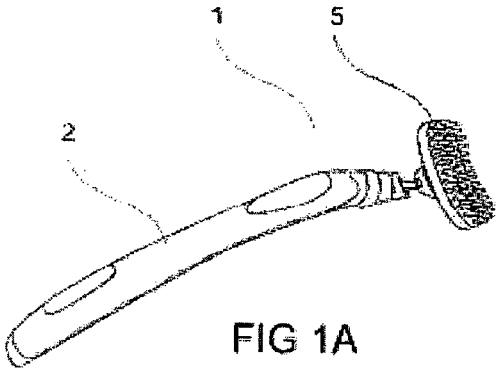
Figure 1B:
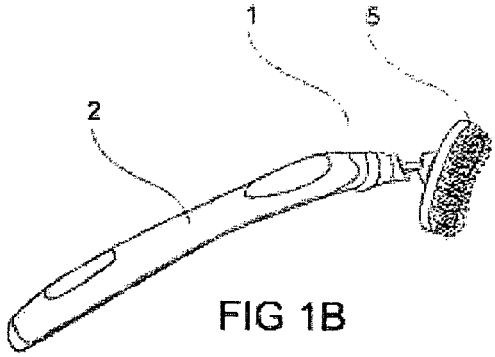
Figure 1C:
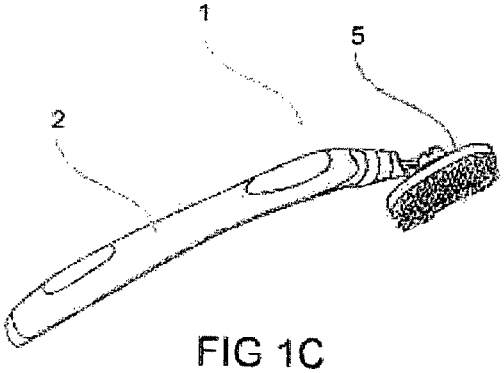
Figure 1D:
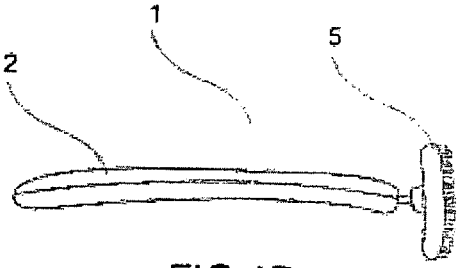
Figure 1E:
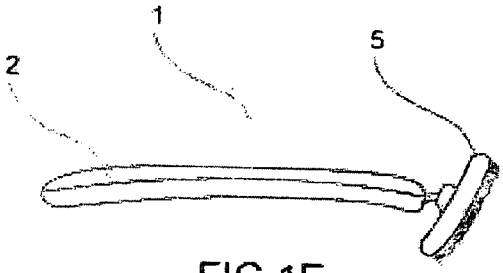
Figure 1F:
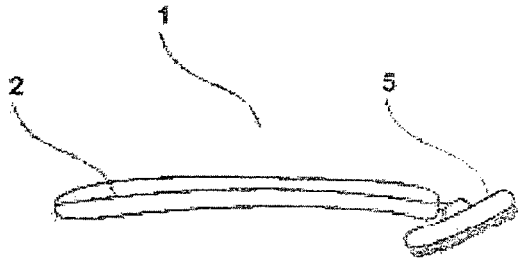
Figure 2A:
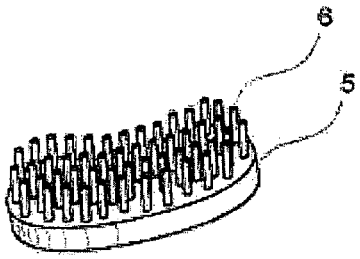
Figure 2B:
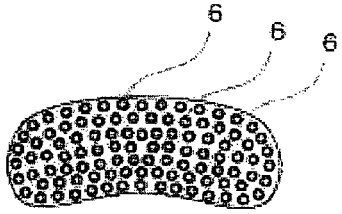
Figure 3:
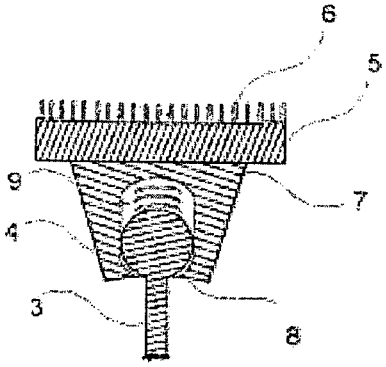
Figure 4:
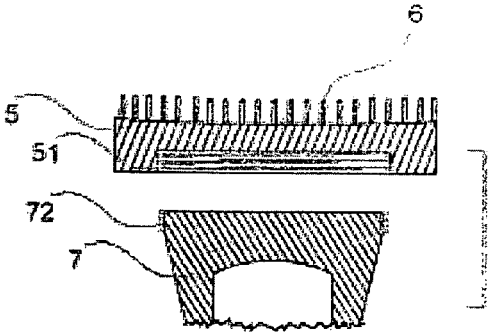
Figure 5:
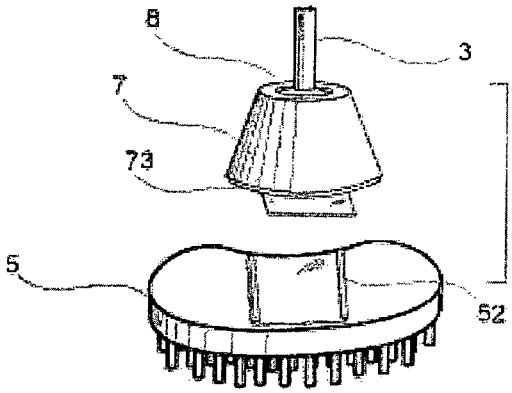
Figure 6A:
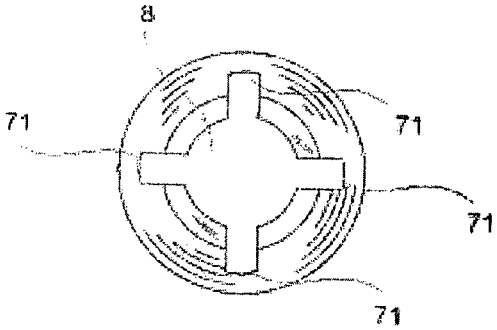
Figure 6B:
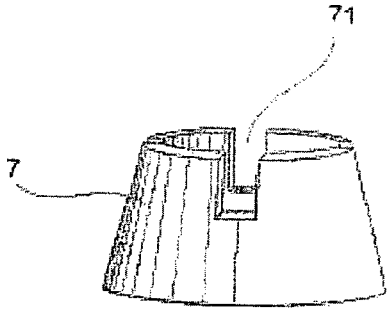
Figure 7:
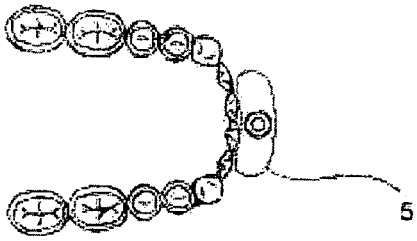
Figure 8:
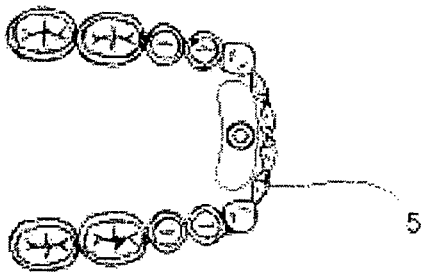
Figure 9:
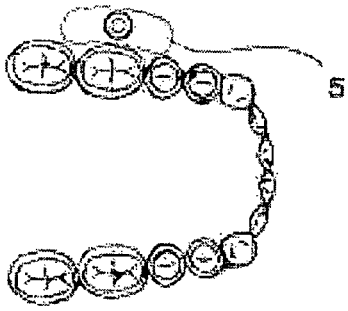
Figure 10:
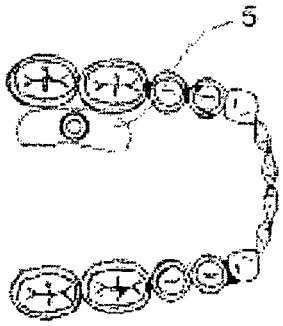
Figure 11:
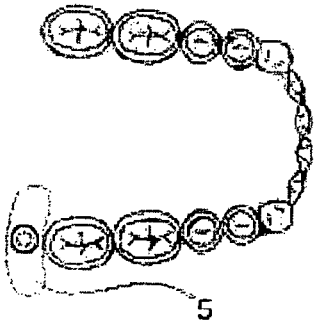
Figure 12:
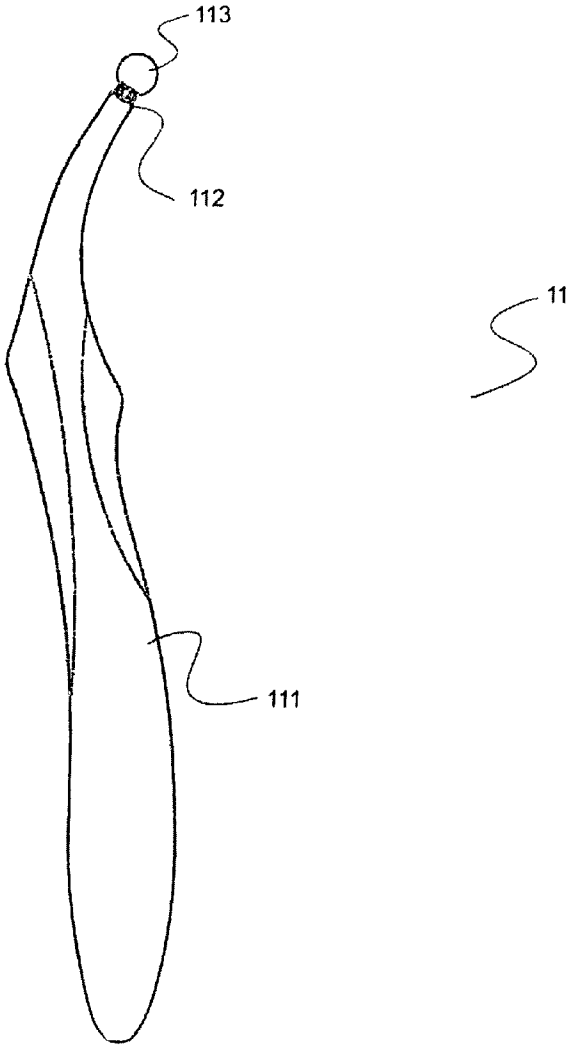
Figure 13:
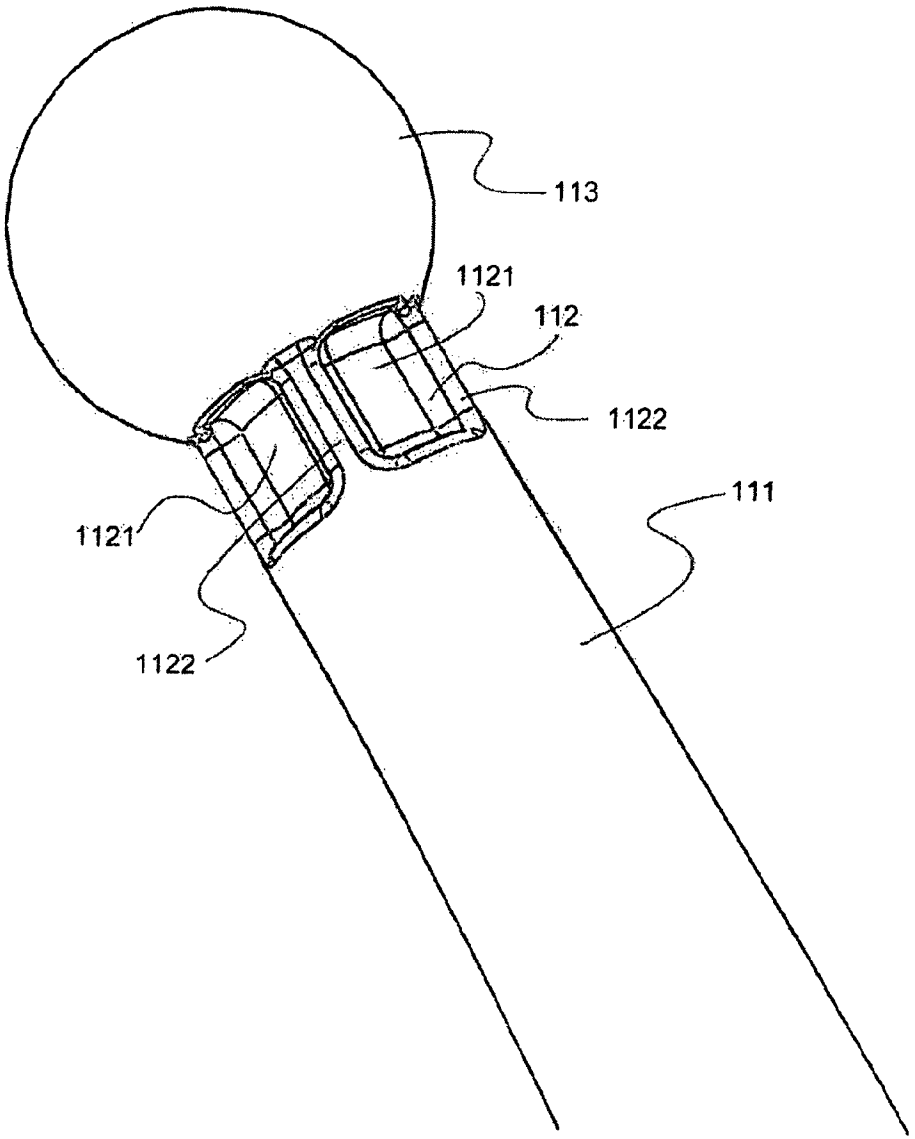
Figure 14:
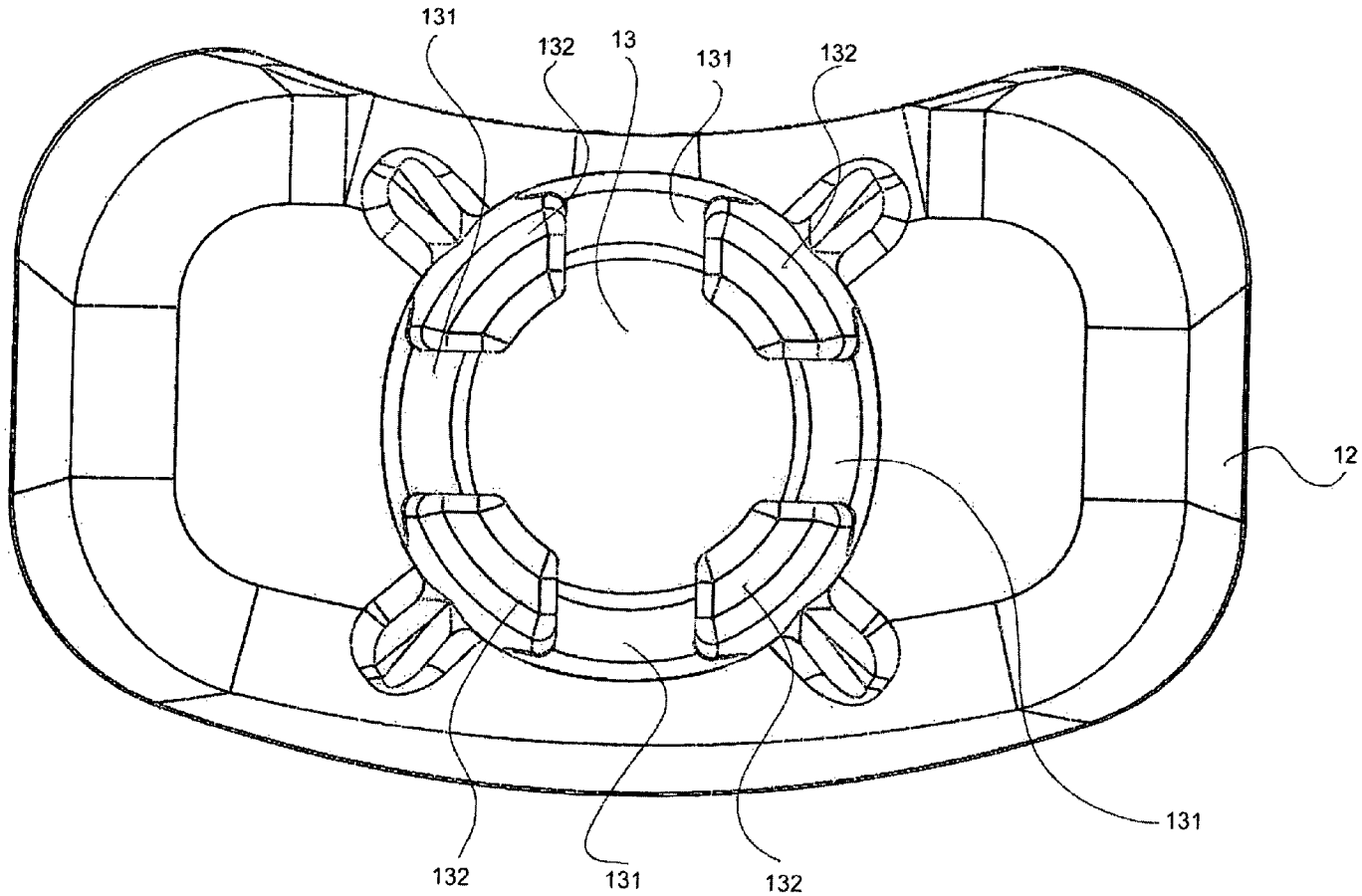
Figure 15:
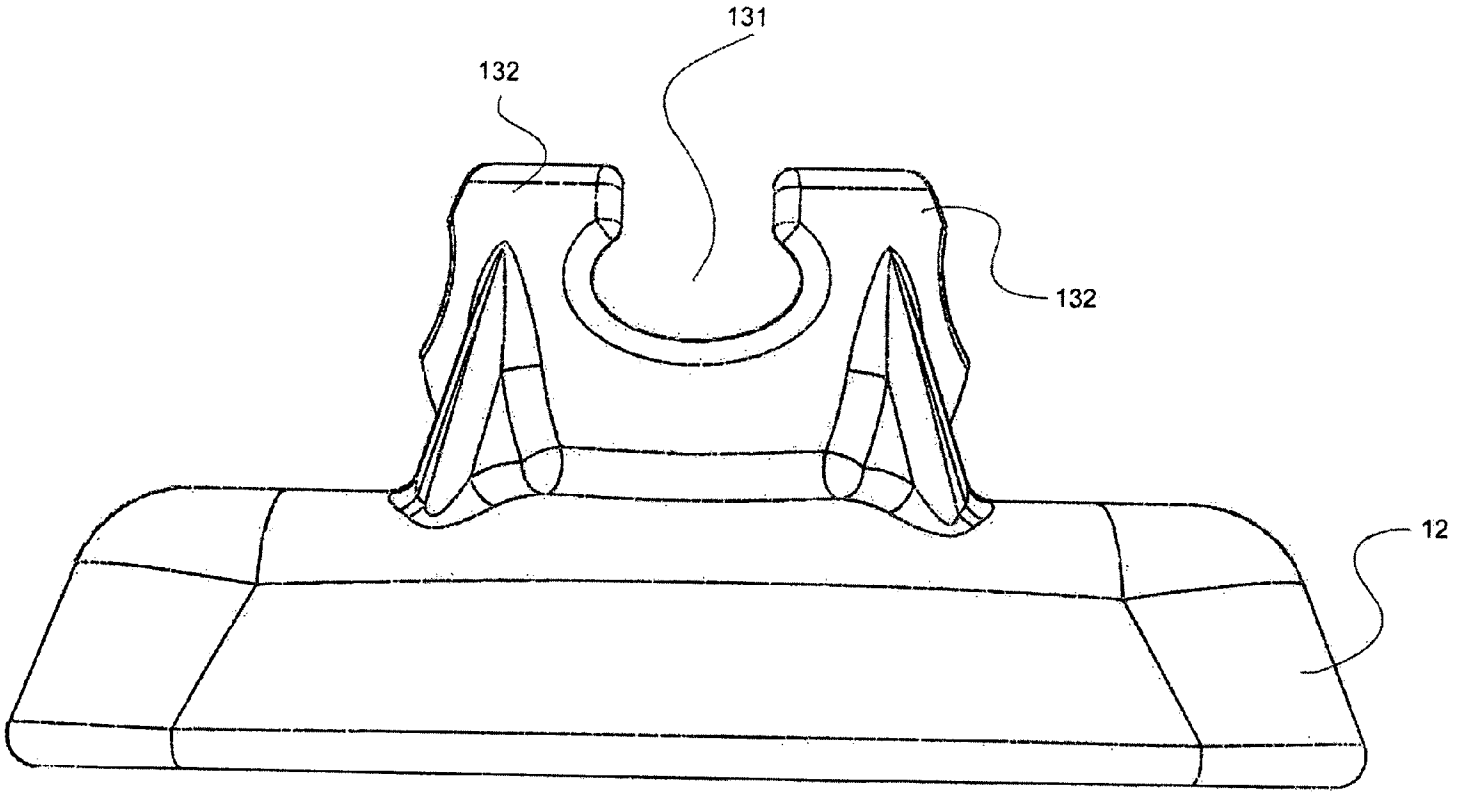
Figure 16:
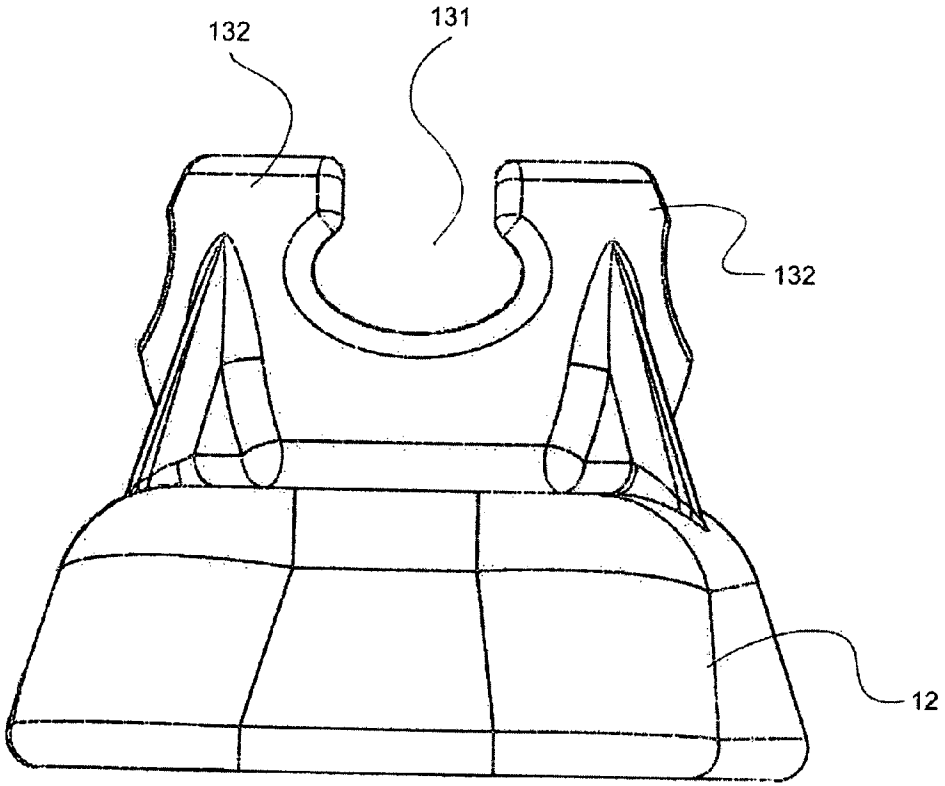
Figure 17:
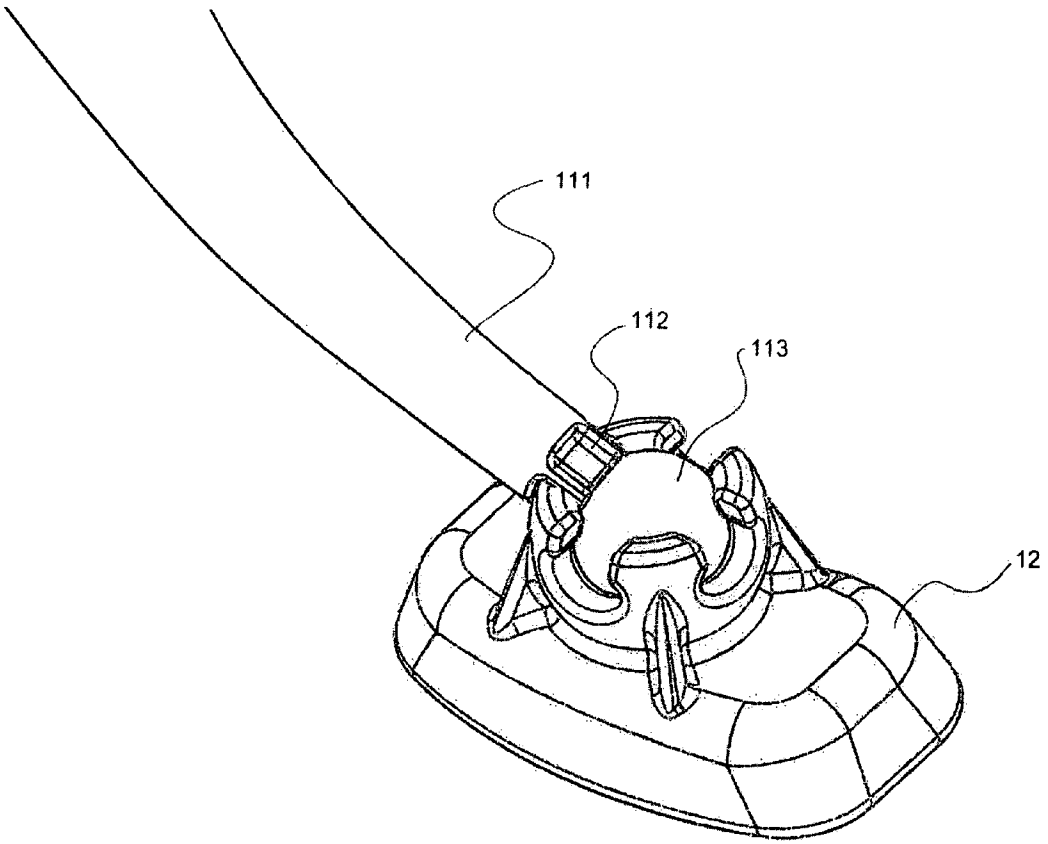
Figure 18:
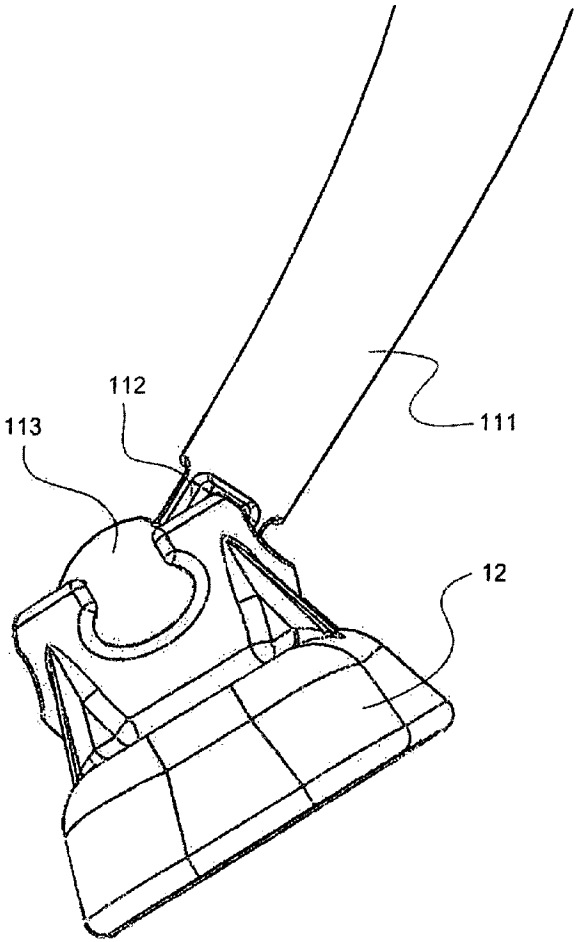
Figure 19:
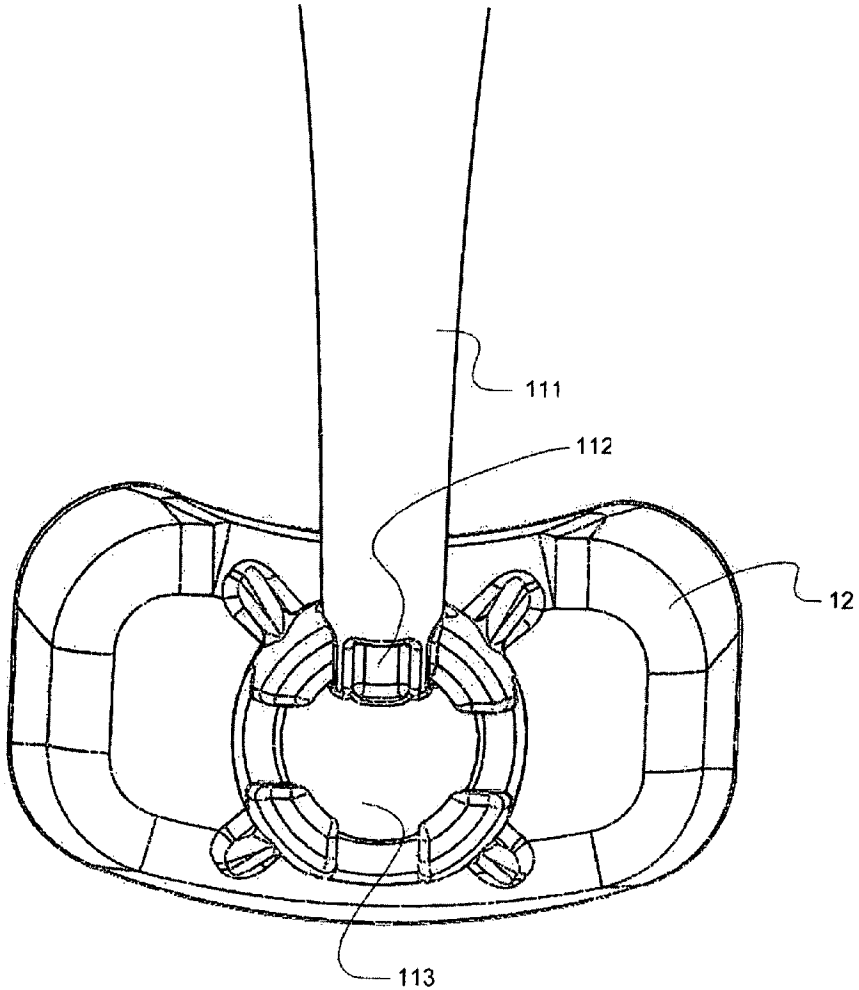
Figure 20:
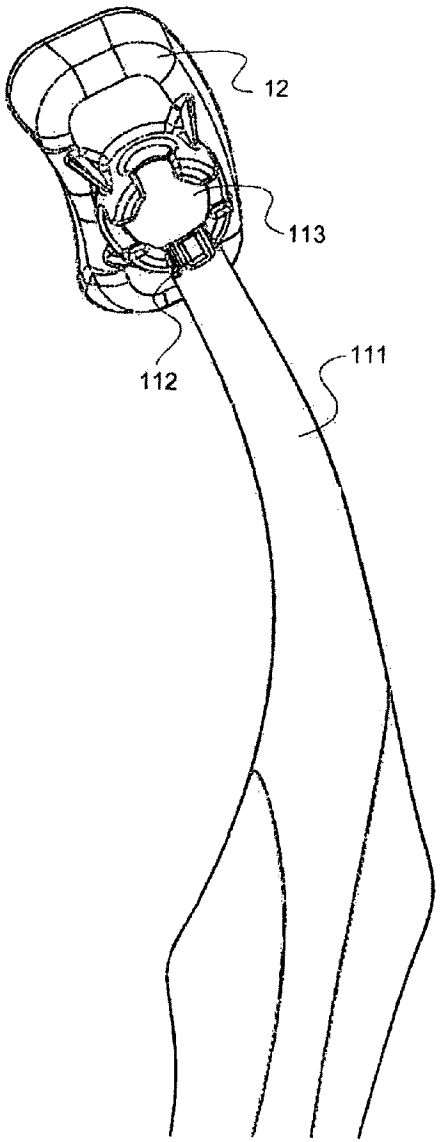
Figure 21:
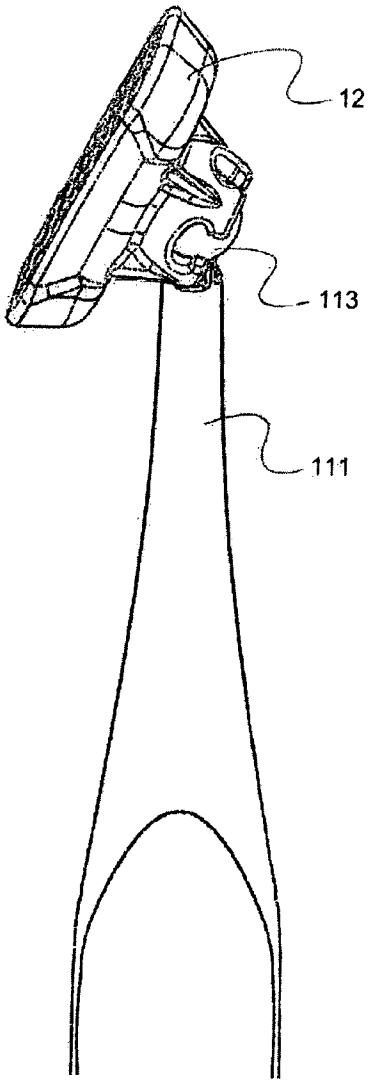
Figure 22:
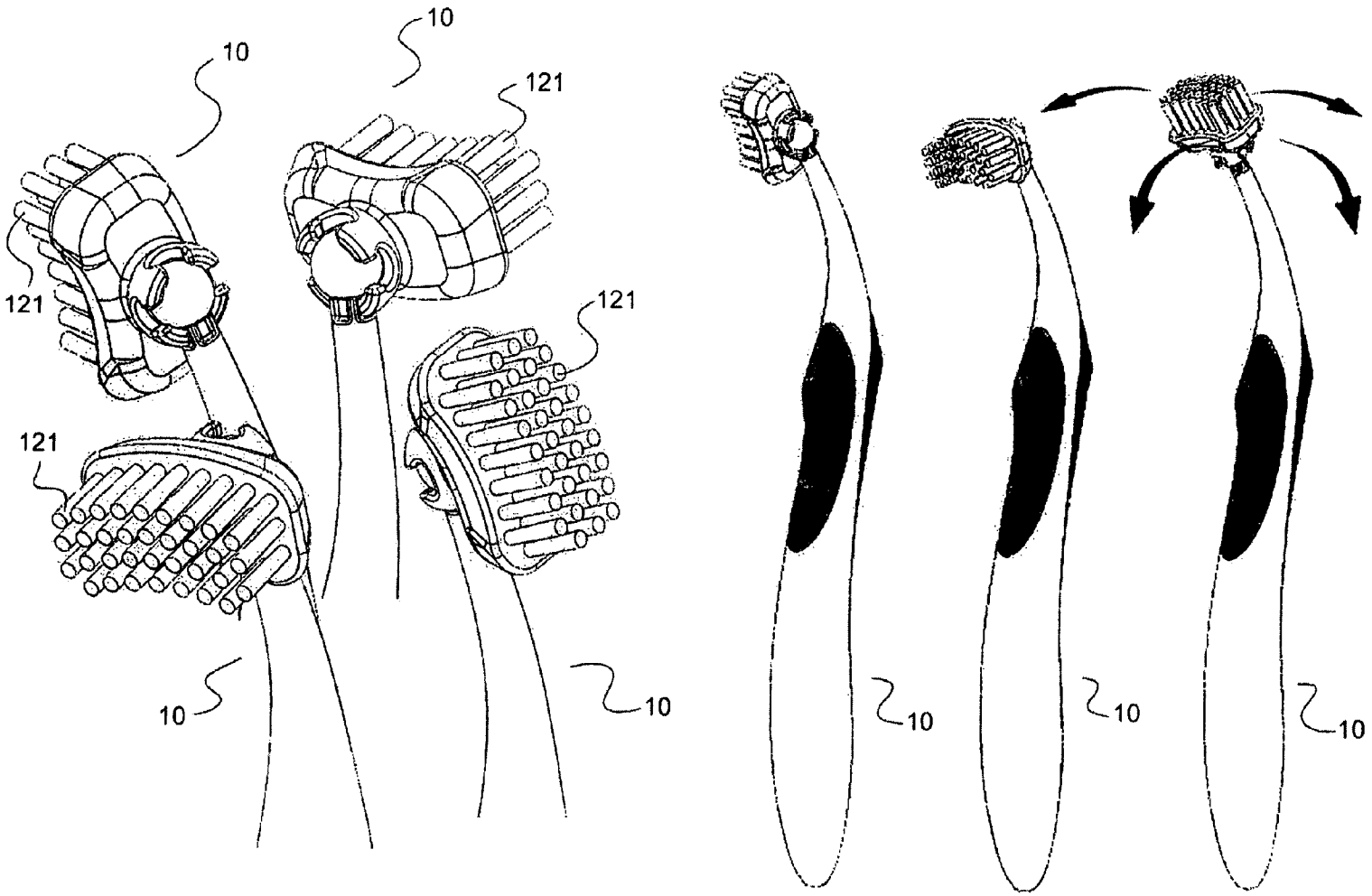
Figure 23:
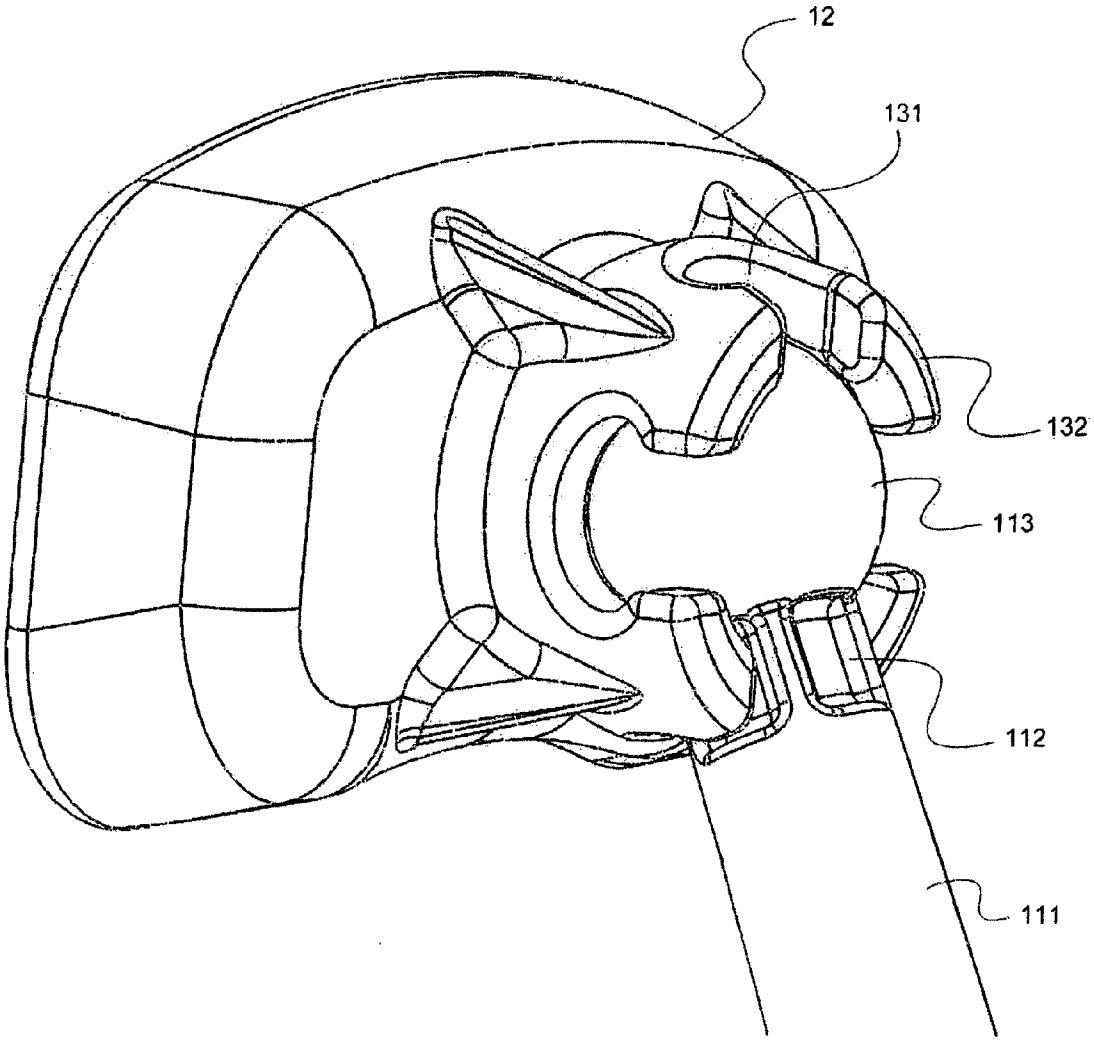
Figure 24:
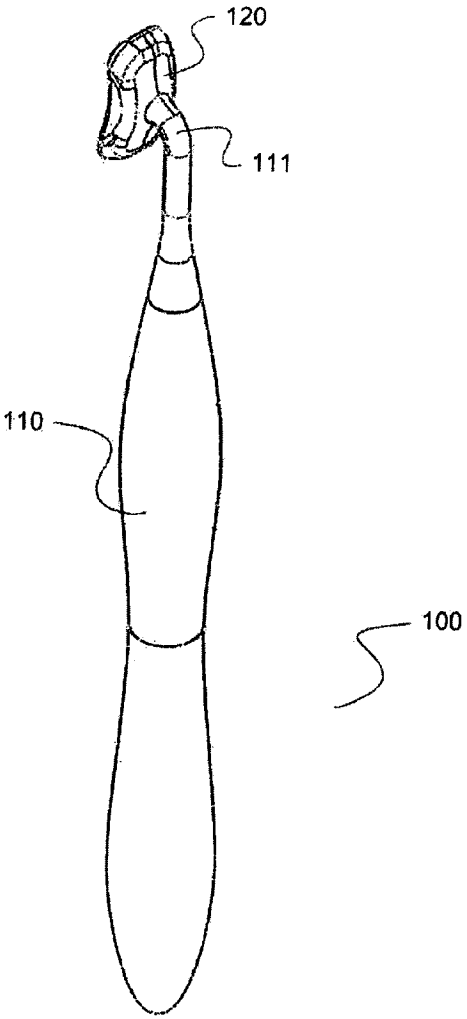
Figure 25:
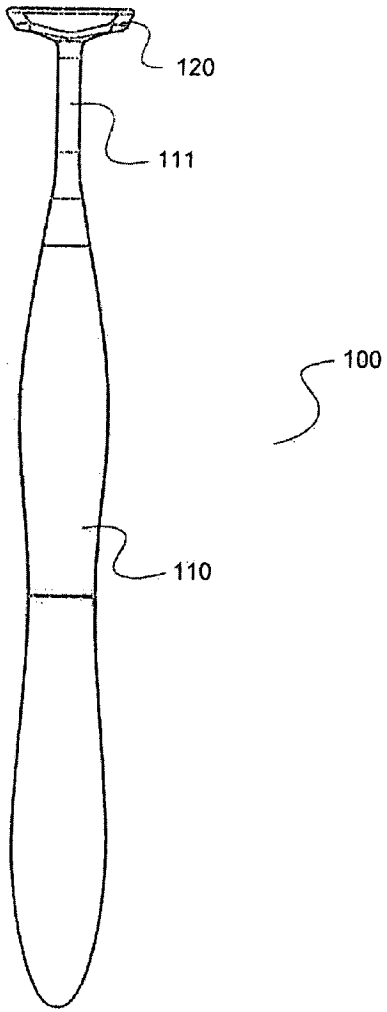
Figure 26:
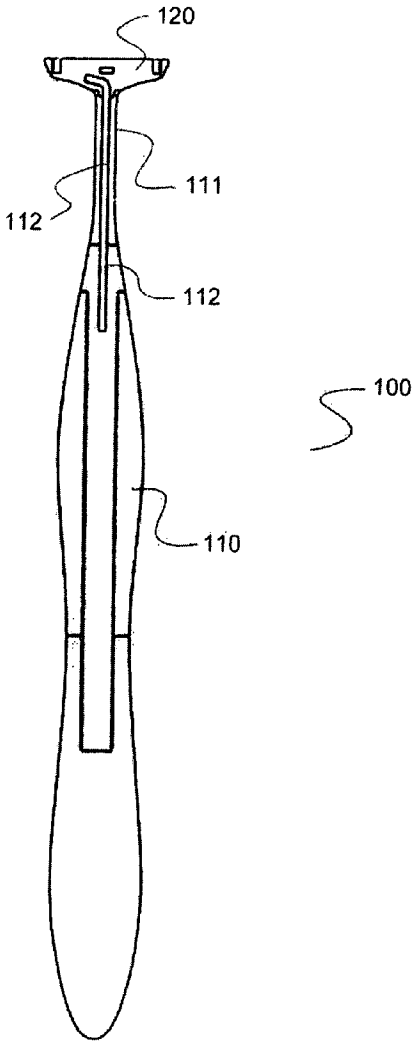
Figure 27:
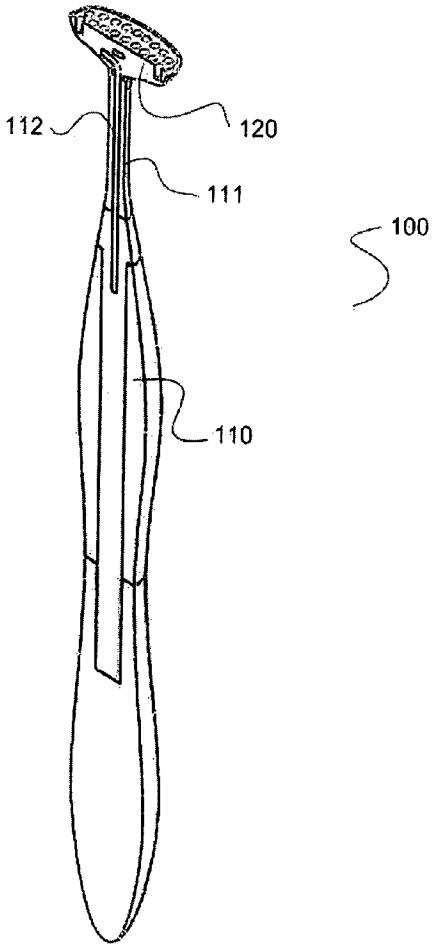
Figure 28:
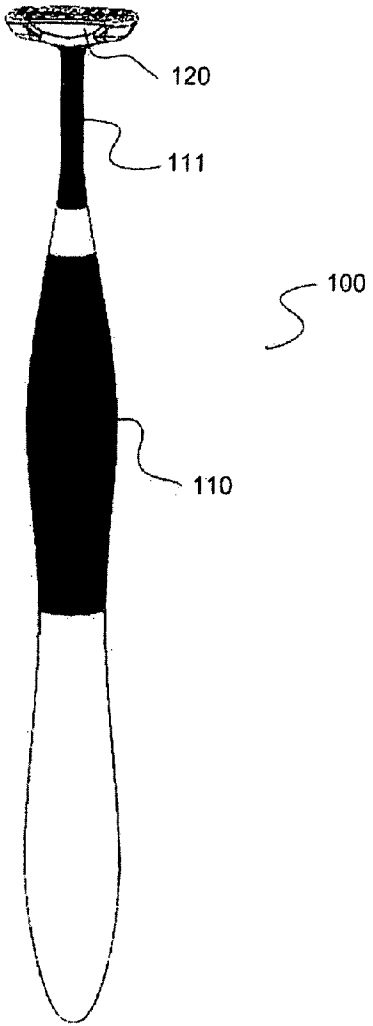
Figure 29:
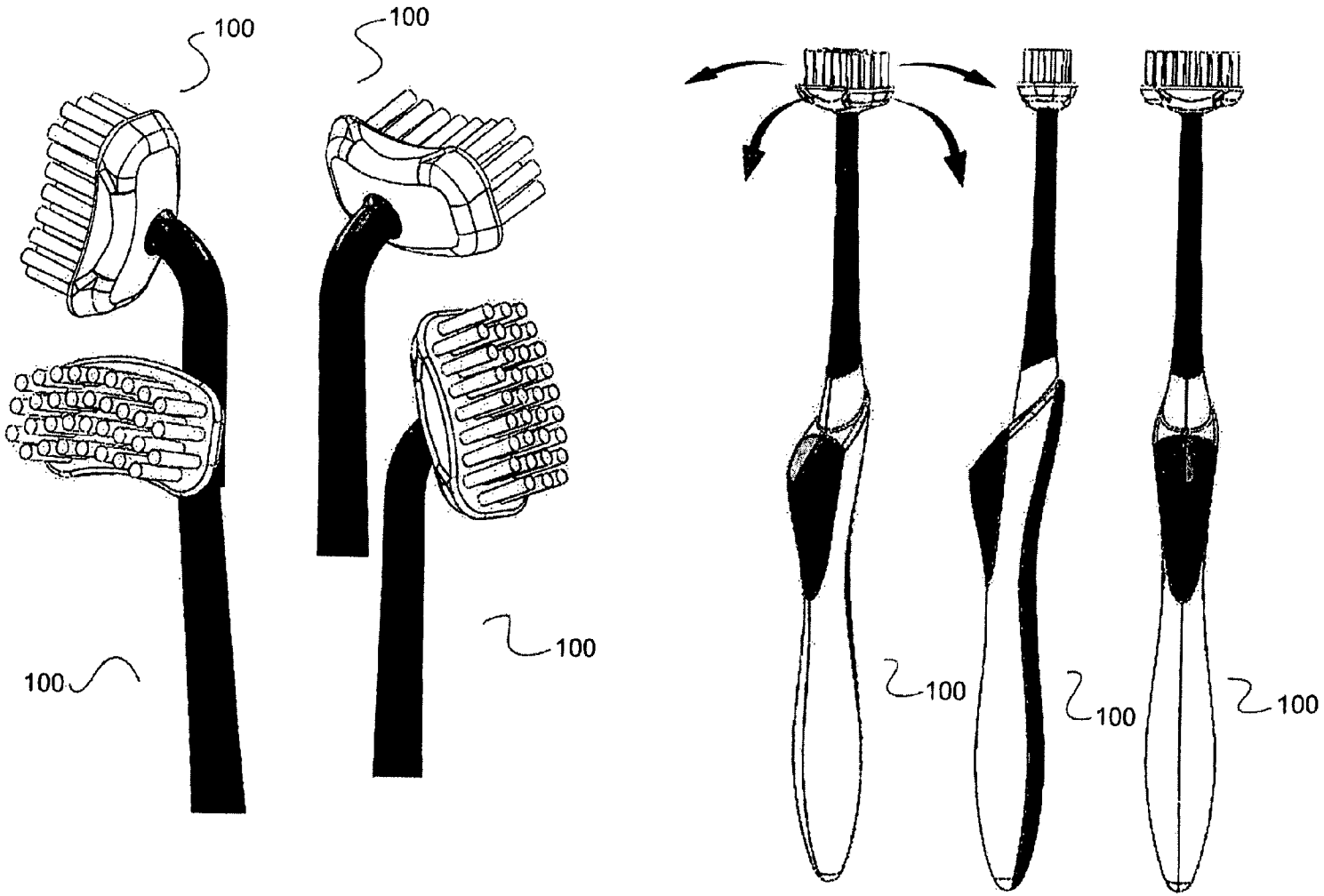
Figure 30:
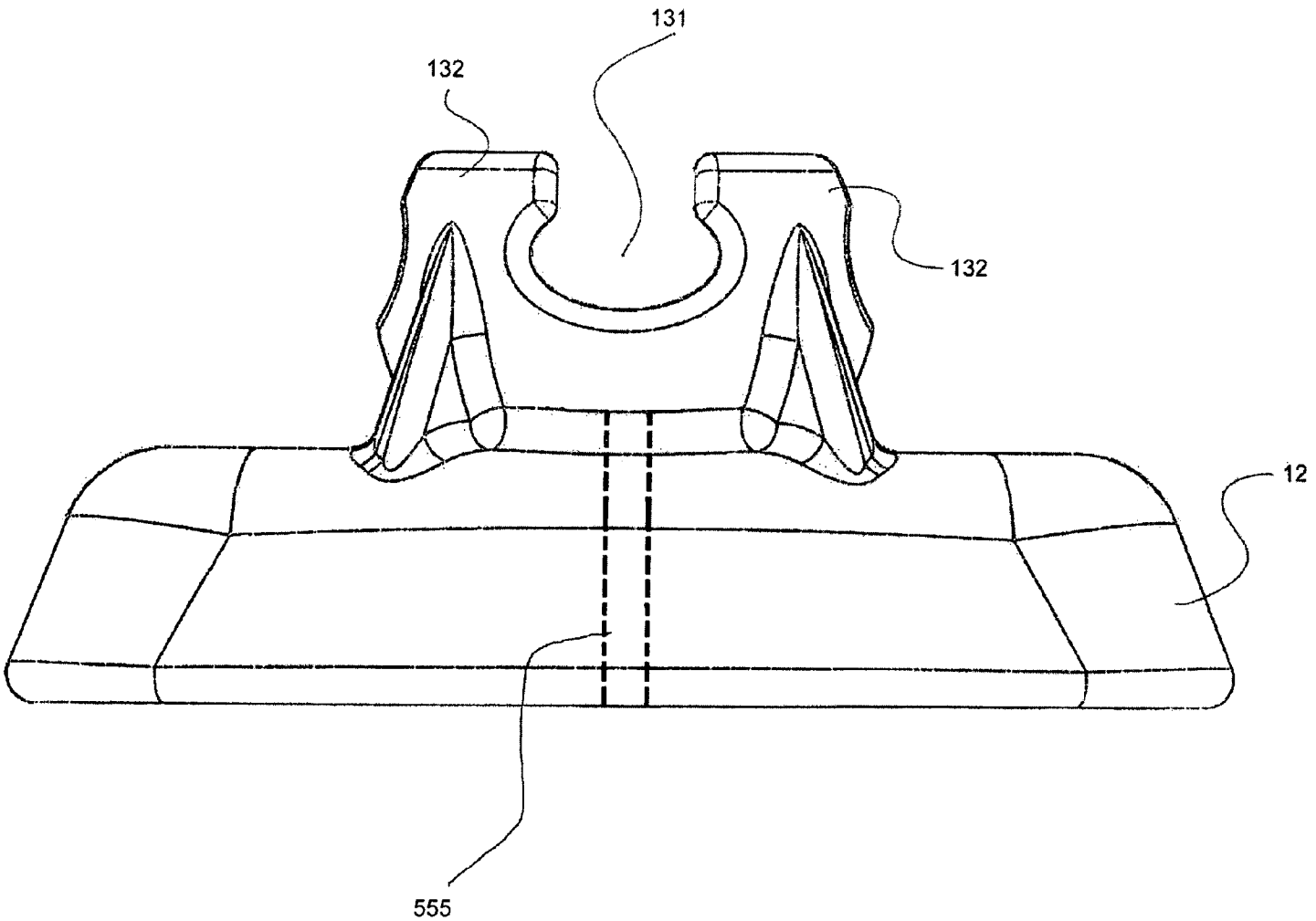
Figure 31:
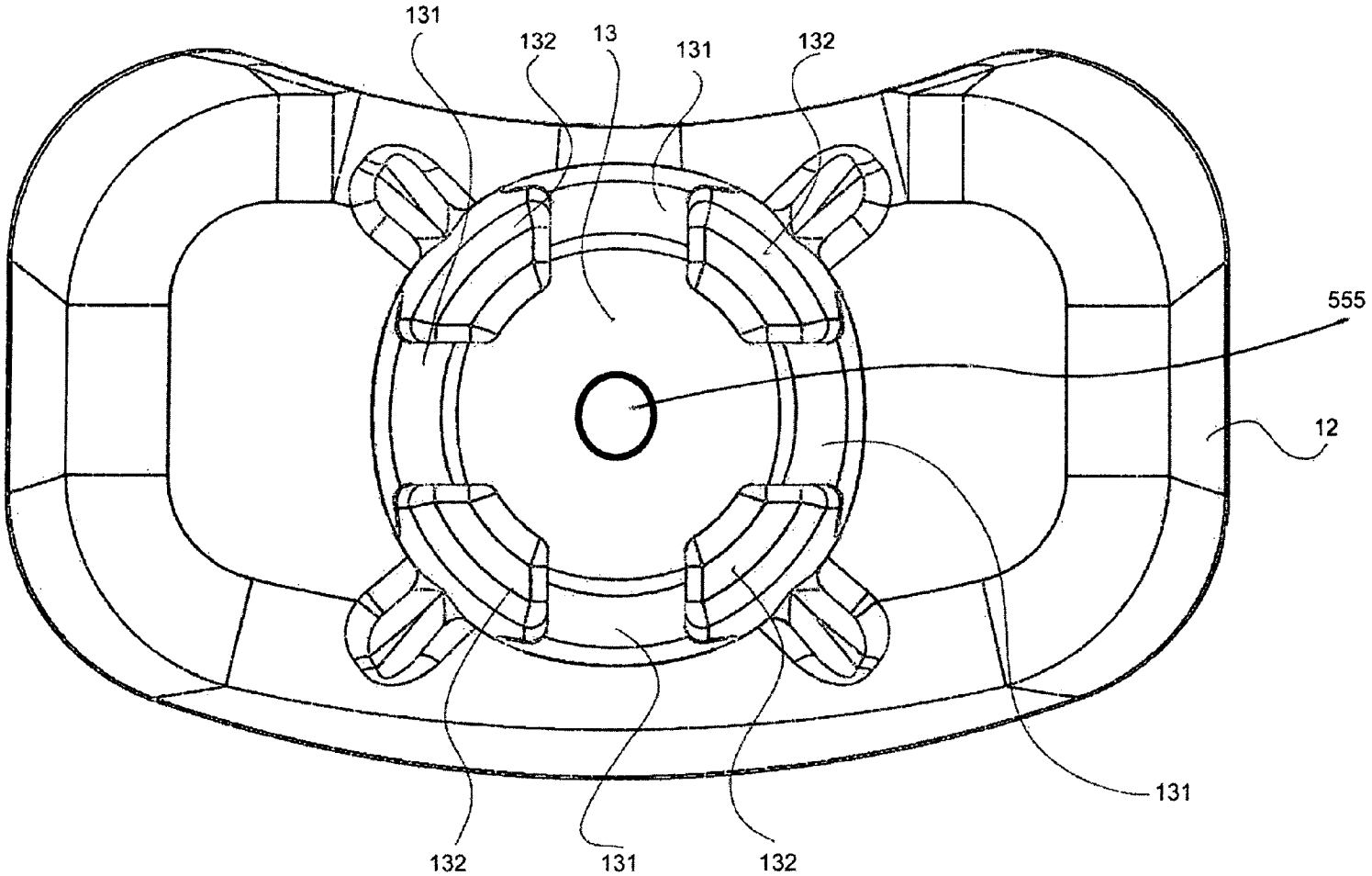

Drawings No. 1C and 1F depict the toothbrush (1) with a 90 degree angle between the longitudinal axis of the bristles of the brush (5) and the longitudinal axis of the handle (2).

Drawings Nos. 2A and 2B depict a bean-shaped brush (5).

Drawing No. 3 depicts a cross-section of the brush (5), the hollow socket (7), the arm (3), the spring (9), and the ball (4) that is inserted into the cavity of the socket (7).

Drawing No. 4 depicts a cross-section of the brush (5) with a cavity with an interior thread (51), and the socket (7) with a matching exterior thread (72).

Drawing No. 5 depicts the brush (5) with sliding tracks (52) and the socket (7) with a matching plate (73) that designed to be locked into the sliding tracks.

Drawing No. 6 depicts the socket (7) with four cut-outs (71).

Drawings Nos. 7-11 depict the ways in which the brush (5) adapts to the curvature of the gums at four different places, and to the back wall of the back (posterior) molar.

Drawing No. 12 depicts the handle (11) which comprises a main body (111), a short square shaft (112), and a ball (113).

Drawing No. 13 depicts the shaft (112), which has four sides (1121) and four protrusions (1122).

Drawings Nos. 14-16 depict the brush (12), which has a socket (13) on one side, with four cut-outs (131) and four prongs (132) in between the cut-outs.

Drawings Nos. 17-21 depict the way in which the handle (11) is attached to the brush (12).

Drawing No. 22 depicts the toothbrush (10) in several positions.

Drawing No. 23 depicts the way in which the handle (11) is attached to the brush (12), in locked position.

Drawings Nos. 24 and 25 depict a toothbrush (100) that is composed of a handle (110) with a flexible neck (111) and a brush (120).

Drawings Nos. 26 and 27 depict a cross-section of the toothbrush (100), which is composed of a handle (110) with a flexible neck (111) with an inner metal wire (112) and a brush (120).

Drawings Nos. 28 and 29 depict the toothbrush (100) in several positions.

Drawings Nos. 30 and 31 depict the brush (12) with the drainage hole (555).

What is claimed is:

1. A toothbrush comprising: a handle having a longitudinal axis with a protruding arm at one end of said handle, said protruding arm ending in a ball-shaped body and extending in a direction that is substantially an extension of said longitudinal axis; and a bean-shaped brush element having a longitudinal axis, a first side and an opposite second side, and opposite concave and convex surfaces, which allow for contacting and cleansing of the contact line between the teeth and gums on the lingual and buccal surfaces of the teeth and on the distal surfaces of the posterior molars, wherein said first side of said brush element has a plurality of bristles arranged in a plurality of arcuate rows protruding therefrom, and wherein said second side of said brush element includes a socket having a cavity formed therein, so that when said brush element is attached to said handle, said ball-shaped body is positioned within said cavity forming a ball and socket joint that enables a user to spatially change the angle between said longitudinal axis of said brush element relative to said longitudinal axis of said handle through a range of 0° to 360°.

2. The toothbrush according to claim No. 1 further comprising a spring that is located within said socket and exerts pressure on said ball-shaped body and on a base of said socket.

3. The toothbrush according to claim No. 2 further including a drainage hole in a floor of said socket cavity positioned so that water, toothpaste and other detritus runs away from said brush element on said first side of said brush element.

4. The toothbrush according to claim No. 1 wherein said ball-shaped body is made of an elastic material and exerts pressure on inner walls of said cavity in said socket.

5. The toothbrush according to claim No. 4 further including a drainage hole in a floor of said socket cavity positioned so that water, toothpaste and other detritus runs away from said brush element on said first side of said brush element.

6. The toothbrush according to claim No. 1 wherein said socket has a plurality of cut-outs that are configured to enable a 90 degree angle between the longitudinal axis of said handle and an axis extending in the same direction as a longitudinal axis of said bristles.

7. The toothbrush according to claim No. 6 further including a drainage hole in a floor of said socket cavity positioned so that water, toothpaste and other detritus runs away from said brush element on said first side of said brush element.

8. The toothbrush according to claim No. 1 wherein said handle, said protruding arm and said ball-shaped body are made from a single solid piece.

9. The toothbrush according to claim No. 8 further including a drainage hole in a floor of said socket cavity positioned so that water, toothpaste and other detritus runs away from said brush element on said first side of said brush element.

10. The toothbrush according to claim No. 1 further including a drainage hole in a floor of said socket cavity positioned so that water, toothpaste and other detritus runs away from said brush element on said first side of said brush element.

11. A toothbrush comprising: a handle having a longitudinal axis with a protruding shaft at one end, said shaft extending in a direction that is substantially an extension of the longitudinal axis of said handle, and said shaft having a square end capped by a ball-shaped body; and a bean-shaped brush element having a first side and an opposite second side, with a plurality of bristles arranged in a plurality of arcuate rows protruding from said first side of said brush element, and a socket with a cavity formed therein positioned in said second side of said brush element, said bean-shaped brush element having a first longitudinal surface and an opposite second longitudinal surface, where said first longitudinal surface is a convex surface and said second longitudinal surface is a concave surface, said surfaces allowing for contacting and cleansing of the contact line between the teeth and gums on the lingual and buccal surfaces of the teeth and the distal surfaces of the posterior molars, wherein a plurality of cut-outs are positioned at the top of said socket enabling a user to set a 90° angle between said longitudinal axis of said handle and an axis extending in the same direction as the longitudinal axis of said bristles, and wherein the centers of the sides of said square end of said shaft are recessed forming protrusions therebetween, and positioned between said cut-outs are prongs which are configured to enter said recesses and said protrusions are configured to encompass said prongs locking said handle into place relative to said brush element.

12. The toothbrush according to claim No. 11 further including a drainage hole in a floor of said socket cavity positioned so that water, toothpaste and other detritus runs away from said brush element on said first side of said brush element.

13. A toothbrush comprising: a handle having a longitudinal axis and which at an end includes a neck formed of a material having plastic properties; and a bean-shaped brush element that has a first side and an opposite second side and that includes a plurality of bristles, said plurality of bristles arranged in a plurality of arcuate rows in a bean-shaped configuration protruding from said first side of said brush element, said bean-shaped brush element having first and second longitudinal surfaces opposite to each other, said first longitudinal surface being a convex surface and said second longitudinal surface being a concave surface, which allow for contacting and cleansing of the contact line between the teeth and gums on the lingual and buccal surfaces of the teeth and the distal surfaces of the posterior molars, and wherein said neck of said handle is attached to said brush element at the center of said second side of said brush element, and said neck is sized so that a user may bend said neck relative to said axis of said handle through 90°, and then said handle is bendable from 0° to 360° around an axis extending in the direction of the longitudinal axis of said bristles, and wherein a metal wire runs along an inner part of said neck and has a bent end which extends into said brush element.

* * * * *